US009435525B1

(12) United States Patent
He et al.

(10) Patent No.: US 9,435,525 B1
(45) Date of Patent: Sep. 6, 2016

(54) MULTI-PART HEAT EXCHANGER FOR LED LAMPS

(71) Applicant: SORAA, INC., Fremont, CA (US)

(72) Inventors: Qinghong He, Fremont, CA (US); Michael R. Krames, Mountain View, CA (US)

(73) Assignee: Soraa, Inc., Fremont, CA (US)

( * ) Notice: Subject to any disclaimer, the term of this patent is extended or adjusted under 35 U.S.C. 154(b) by 15 days.

(21) Appl. No.: 14/199,398

(22) Filed: Mar. 6, 2014

Related U.S. Application Data

(60) Provisional application No. 61/851,513, filed on Mar. 8, 2013.

(51) Int. Cl.
*F21V 29/00* (2015.01)
*F21K 99/00* (2016.01)

(52) U.S. Cl.
CPC ..... *F21V 29/20* (2013.01); *F21K 9/00* (2013.01); *F21V 29/008* (2013.01)

(58) Field of Classification Search
CPC ..... F21V 29/20; F21V 29/008; F21V 29/22; F21V 29/2206; F21V 29/50; F21V 29/502; F21V 29/70; F21V 29/85; F21V 29/24; F21V 29/246; F21K 9/00
See application file for complete search history.

(56) References Cited

U.S. PATENT DOCUMENTS

| | | | |
|---|---|---|---|
| 2,953,970 | A | 9/1960 | Maynard |
| 3,283,143 | A | 11/1966 | Gosnell |
| 3,593,021 | A | 7/1971 | Auerbach |
| 3,621,233 | A | 11/1971 | Ferdinand et al. |
| 3,874,443 | A | 4/1975 | Bayer, Jr. |
| 4,165,919 | A | 8/1979 | Little |
| 4,225,904 | A | 9/1980 | Linder |
| 4,279,463 | A | 7/1981 | Little |
| 4,293,892 | A | 10/1981 | Plummer |
| 5,005,109 | A | 4/1991 | Carleton |
| 6,116,758 | A | 9/2000 | Lin |
| 6,204,602 | B1 | 3/2001 | Yang et al. |
| D471,881 | S | 3/2003 | Hegde |
| 6,787,999 | B2 | 9/2004 | Stimac et al. |
| 6,864,572 | B2 | 3/2005 | Lee et al. |
| 6,889,006 | B2 | 5/2005 | Kobayashi |
| 6,942,368 | B1 | 9/2005 | Kane et al. |
| 6,964,877 | B2 | 11/2005 | Chen et al. |
| 7,207,694 | B1 | 4/2007 | Petrick |
| D545,457 | S | 6/2007 | Chen |
| 7,311,417 | B1 | 12/2007 | Lemke |
| 7,344,279 | B2 | 3/2008 | Mueller et al. |
| 7,388,751 | B2 | 6/2008 | Hood et al. |

(Continued)

FOREIGN PATENT DOCUMENTS

| | | |
|---|---|---|
| CN | 1849707 | 10/2006 |
| CN | 2826150 Y | 10/2006 |

(Continued)

OTHER PUBLICATIONS

USPTO Notice of Allowance for U.S. Appl. No. 13/274,489 dated Sep. 30, 2014 (7 pages).

(Continued)

*Primary Examiner* — Bao Q Truong
(74) *Attorney, Agent, or Firm* — Saul Ewing LLP

(57) ABSTRACT

Multi-part heat exchangers for hot/cold temperature domain isolation in LED lamps are disclosed.

16 Claims, 7 Drawing Sheets

(56) References Cited

U.S. PATENT DOCUMENTS 7,431,071 B2 10/2008 Wenger
D581,583 S 11/2008 Peng
7,458,706 B1 12/2008 Liu et al.
7,488,097 B2 2/2009 Reisenauer et al.
7,506,998 B2 3/2009 Ansems et al.
D592,613 S 5/2009 Plonski et al.
7,631,987 B2 12/2009 Wei
7,637,635 B2 12/2009 Xiao et al.
7,658,528 B2 2/2010 Hoelen et al.
7,663,229 B2 2/2010 Lu et al.
7,674,015 B2 3/2010 Chien
7,712,922 B2 5/2010 Hacker et al.
D618,634 S 6/2010 Lin et al.
7,744,259 B2 6/2010 Walczak et al.
D619,551 S 7/2010 Lin et al.
7,748,870 B2 7/2010 Chang et al.
7,753,107 B2 7/2010 Zhou et al.
7,800,119 B2 9/2010 He et al.
7,824,075 B2 11/2010 Maxik
7,824,077 B2 11/2010 Chen et al.
7,837,363 B2 * 11/2010 Liu ..... 362/373
7,889,421 B2 2/2011 Narendran et al.
7,972,040 B2 7/2011 Li et al.
7,993,025 B2 8/2011 Chiu
7,993,031 B2 8/2011 Grajcar
7,997,774 B2 8/2011 Liddle
8,042,969 B2 10/2011 Paik et al.
8,049,122 B2 11/2011 Watford
D652,564 S 1/2012 Maxik
8,153,475 B1 4/2012 Shum et al.
8,157,422 B2 4/2012 Paik et al.
8,164,237 B2 4/2012 Wen
8,206,015 B2 6/2012 Cho et al.
D662,899 S 7/2012 Shum et al.
D662,900 S 7/2012 Shum et al.
8,215,800 B2 7/2012 Plank
8,220,970 B1 7/2012 Khazi et al.
8,227,962 B1 7/2012 Su
8,242,669 B2 8/2012 Qiu
8,272,762 B2 9/2012 Maxik et al.
8,324,835 B2 12/2012 Shum et al.
D674,960 S 1/2013 Chen et al.
8,390,207 B2 3/2013 Dowling et al.
8,405,947 B1 3/2013 Green et al.
8,414,151 B2 4/2013 Allen et al.
8,525,396 B2 9/2013 Shum et al.
8,567,999 B2 10/2013 Paik et al.
8,579,470 B1 11/2013 Leahy et al.
D694,722 S 12/2013 Shum et al.
8,618,742 B2 12/2013 Shum et al.
8,643,257 B2 2/2014 Shum et al.
8,651,711 B2 2/2014 Rudisill et al.
8,680,787 B2 3/2014 Veskovic
8,746,918 B1 6/2014 Rubino
8,752,975 B2 6/2014 Rubino
8,803,452 B2 8/2014 Shum et al.
8,829,774 B1 * 9/2014 Shum ..... F21K 9/90 313/46
8,884,501 B2 11/2014 Cho et al.
8,884,517 B1 * 11/2014 Shum ..... F21K 9/13 315/32
8,888,332 B2 11/2014 Martis et al.
8,907,550 B2 * 12/2014 Zaderej ..... F21K 9/00 313/46
8,915,624 B2 * 12/2014 Manahan ..... 362/373
9,080,759 B2 * 7/2015 Osawa et al.
2001/0021073 A1 9/2001 Leggo et al.
2003/0039122 A1 2/2003 Cao
2003/0058650 A1 3/2003 Shih
2003/0107885 A1 6/2003 Galli
2003/0183835 A1 10/2003 Moku et al.
2004/0222427 A1 11/2004 Hsiung
2004/0264195 A1 12/2004 Chang et al.
2005/0122690 A1 6/2005 Hood et al.
2005/0174780 A1 8/2005 Park
2006/0028310 A1 2/2006 Asano et al.
2006/0175045 A1 8/2006 Chen
2006/0262545 A1 11/2006 Piepgras et al.
2006/0274529 A1 12/2006 Cao
2007/0007898 A1 1/2007 Bruning
2007/0158797 A1 7/2007 Lee
2007/0228999 A1 10/2007 Kit
2007/0284564 A1 12/2007 Biwa et al.
2008/0002444 A1 1/2008 Shekhawat et al.
2008/0049399 A1 2/2008 Lu et al.
2008/0080137 A1 4/2008 Otsuki et al.
2008/0123341 A1 5/2008 Chiu
2008/0158887 A1 7/2008 Zhu et al.
2008/0266866 A1 10/2008 Tsai
2008/0315228 A1 12/2008 Krames et al.
2009/0027878 A1 1/2009 Metz et al.
2009/0134421 A1 5/2009 Negley
2009/0154166 A1 6/2009 Zhang et al.
2009/0161356 A1 * 6/2009 Negley et al. ..... 362/231
2009/0175043 A1 7/2009 Frick
2009/0194252 A1 8/2009 Lee et al.
2009/0195186 A1 8/2009 Guest et al.
2009/0231895 A1 9/2009 Hu
2009/0237940 A1 9/2009 Wu et al.
2009/0244899 A1 10/2009 Chyn
2009/0303738 A1 12/2009 Suss et al.
2009/0303762 A1 12/2009 Jang et al.
2010/0060130 A1 3/2010 Li
2010/0061076 A1 3/2010 Mandy et al.
2010/0066266 A1 3/2010 Huang et al.
2010/0091487 A1 4/2010 Shin
2010/0207502 A1 8/2010 Cao et al.
2010/0207534 A1 8/2010 Dowling et al.
2010/0244648 A1 9/2010 Yoo
2010/0264799 A1 10/2010 Liu et al.
2010/0277068 A1 11/2010 Broitzman
2010/0290229 A1 11/2010 Meyer, Sr. et al.
2010/0320499 A1 12/2010 Catalano et al.
2011/0018418 A1 1/2011 Yoo
2011/0032708 A1 2/2011 Johnston et al.
2011/0074270 A1 3/2011 Van De Ven et al.
2011/0095686 A1 4/2011 Falicoff et al.
2011/0140586 A1 6/2011 Wang
2011/0169406 A1 7/2011 Weekamp et al.
2011/0175510 A1 7/2011 Rains, Jr. et al.
2011/0175528 A1 7/2011 Rains, Jr. et al.
2011/0182065 A1 7/2011 Negley et al.
2011/0198979 A1 8/2011 Shum et al.
2011/0204763 A1 8/2011 Shum et al.
2011/0204779 A1 8/2011 Shum et al.
2011/0204780 A1 8/2011 Shum et al.
2011/0215699 A1 9/2011 Le et al.
2011/0242823 A1 10/2011 Tracy et al.
2011/0260945 A1 10/2011 Karasawa
2011/0298371 A1 12/2011 Brandes et al.
2011/0309734 A1 12/2011 Lin et al.
2012/0018754 A1 1/2012 Lowes
2012/0043552 A1 2/2012 David et al.
2012/0043913 A1 2/2012 Melanson
2012/0161626 A1 6/2012 van de Ven et al.
2012/0187830 A1 7/2012 Shum et al.
2012/0195053 A1 * 8/2012 Wu ..... 362/373
2012/0212960 A1 8/2012 Rodriguez
2012/0293062 A1 11/2012 Pickard
2012/0314403 A1 12/2012 Kennedy et al.
2012/0319148 A1 12/2012 Donofrio et al.
2012/0320579 A1 12/2012 Ferguson et al.
2013/0058099 A1 3/2013 Shum et al.
2013/0322089 A1 12/2013 Martis et al.
2013/0343062 A1 12/2013 Shum et al.
2014/0028214 A1 1/2014 Mazumdar et al.
2014/0091697 A1 4/2014 Shum
2014/0146545 A1 5/2014 Shum et al.
2014/0175966 A1 6/2014 Tan
2014/0313749 A1 10/2014 Shum et al.

(56) References Cited

U.S. PATENT DOCUMENTS

FOREIGN PATENT DOCUMENTS

| | | |
|---|---|---|
| CN | 2009-75612 | 11/2007 |
| CN | 101608746 | 8/2011 |
| CN | 102149960 | 8/2011 |
| CN | 203099372 U | 7/2013 |
| JP | 02-028541 | 1/1990 |
| JP | 2000-517465 | 12/2000 |
| JP | 2005-302483 | 10/2009 |
| JP | 2011-501351 | 1/2011 |
| WO | WO 2009/048956 | 3/2009 |
| WO | WO 2009/149263 | 12/2009 |
| WO | WO 2009/156969 | 12/2009 |
| WO | WO 2011/054716 | 5/2011 |

OTHER PUBLICATIONS

USPTO Office Action for U.S. Appl. No. 13/535,142 dated Sep. 22, 2014 (25 pages).
USPTO Notice of Allowance for U.S. Appl. No. 13/856,613 dated Nov. 21, 2014 (8 pages).
USPTO Notice of Allowance for U.S. Appl. No. 13/909,752 dated Sep. 30, 2014 (9 pages).
USPTO Office Action for U.S. Appl. No. 14/014,112 dated Nov. 19, 2014 (24 pages).
USPTO Office Action for U.S. Appl. No. 14/054,597 dated Dec. 5, 2014 (9 pages).
USPTO Office Action for U.S. Appl. No. 14/075,936 dated Sep. 24, 2014 (7 pages).
USPTO Office Action for U.S. Appl. No. 14/097,043 dated Oct. 15, 2014 (11 pages).
USPTO Office Action for U.S. Appl. No. 14/211,606 dated Nov. 28, 2014 (18 pages).
Communication from the Japanese Patent Office re 2013532993 dated Jul. 9, 2014 (5 pages).
USPTO Notice of Allowance for U.S. Appl. No. 13/959,422 dated Jul. 9, 2014 (7 pages).
Nakamura, 'Candela-Class High-Brightness InGaN/AlGaN Double-Heterostructure Blue-Light-Emitting Diodes', Applied Physics Letters, vol. 64, No. 13, Mar. 1994, p. 1687-1689.
International Preliminary Report & Written Opinion of PCT Application No. PCT/US2011/060030 dated Mar. 21, 2012, 11 pgs. total.
CFL Ballast IC Drive LED', www.placardshop.com, Blog, May 22, 2012, 3 pgs.
Thermal Properties of Plastic Materials', Professional Plastics, Aug. 21, 2010, pp. 1-4.
Rausch, 'Use a CFL ballast to drive LEDs', EDN Network, 2007, pp. 1-2.
Communication from the Chinese Patent Office re 201210322687.1 dated Mar. 3, 2014, (8 pages).
USPTO Office Action for U.S. Appl. No. 13/025,791 dated Nov. 25, 2011 (11 pages).
USPTO Office Action for U.S. Appl. No. 13/025,791 dated Feb. 20, 2013 (13 pages).
USPTO Notice of Allowance for U.S. Appl. No. 13/025,791 dated Jun. 17, 2013 (8 pages).
USPTO Office Action for U.S. Appl. No. 13/025,833 dated Dec. 14, 2011 (10 pages).
USPTO Office Action for U.S. Appl. No. 13/025,833 dated Jul. 12, 2012 (15 pages).
USPTO Office Action for U.S. Appl. No. 13/025,833 dated Apr. 26, 2013 (22 pages).
USPTO Notice of Allowance for U.S. Appl. No. 13/025,833 dated Oct. 11, 2013 (11 pages).
USPTO Office Action for U.S. Appl. No. 13/025,849 dated Mar. 15, 2013 (17 pages).
USPTO Notice of Allowance for U.S. Appl. No. 13/025,849 dated Sep. 16, 2013 (10 pages).
USPTO Office Action for U.S. Appl. No. 13/025,860 dated Dec. 30, 2011 (14 pages).
USPTO Notice of Allowance for U.S. Appl. No. 13/025,860 dated Jun. 8, 2012 (9 pages).
USPTO Office Action for U.S. Appl. No. 13/269,193 dated Oct. 3, 2013 (12 pages).
USPTO Notice of Allowance for U.S. Appl. No. 13/269,193 dated Mar. 31, 2014 (8 pages).
USPTO Office Action for U.S. Appl. No. 13/274,489 dated Sep. 6, 2013 (12 pages).
USPTO Office Action for U.S. Appl. No. 13/274,489 dated Mar. 27, 2014 (14 pages).
USPTO Office Action for U.S. Appl. No. 13/480,767 dated Oct. 25, 2013 (28 pages).
USPTO Office Action for U.S. Appl. No. 13/480,767 dated Apr. 29, 2014 (21 pages).
USPTO Office Action for U.S. Appl. No. 13/535,142 dated Aug. 1, 2013 (13 pages).
USPTO Office Action for U.S. Appl. No. 13/535,142 dated Nov. 14, 2013 (23 pages).
USPTO Office Action for U.S. Appl. No. 13/535,142 dated Feb. 25, 2014 (23 pages).
USPTO Office Action for U.S. Appl. No. 13/959,422 dated Oct. 8, 2013 (10 pages).
USPTO Notice of Allowance for U.S. Appl. No. 29/399,523 dated Mar. 5, 2012 (7 pages).
USPTO Notice of Allowance for U.S. Appl. No. 29/399,524 dated Mar. 2, 2012 (8 pages).
USPTO Notice of Allowance for U.S. Appl. No. 29/423,725 dated Jul. 19, 2013 (9 pages).
Communication from the Chinese Patent Office re 2011800543977 dated Jan. 7, 2015 (13 pages).
USPTO Office Action for U.S. Appl. No. 13/480,767 dated Dec. 18, 2014 (17 pages).
USPTO Office Action for U.S. Appl. No. 13/855,423 dated Mar. 17, 2015 (22 pages).
USPTO Notice of Allowance for U.S. Appl. No. 29/441,108 dated Mar. 13, 2015 (7 pages).
USPTO Notice of Allowance for U.S. Appl. No. 29/469,709 dated Feb. 6, 2015 (5 pages).

* cited by examiner

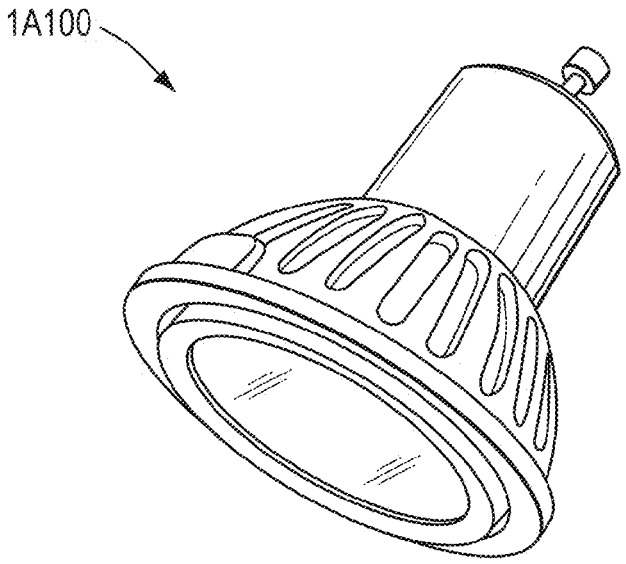
FIG. 1A1
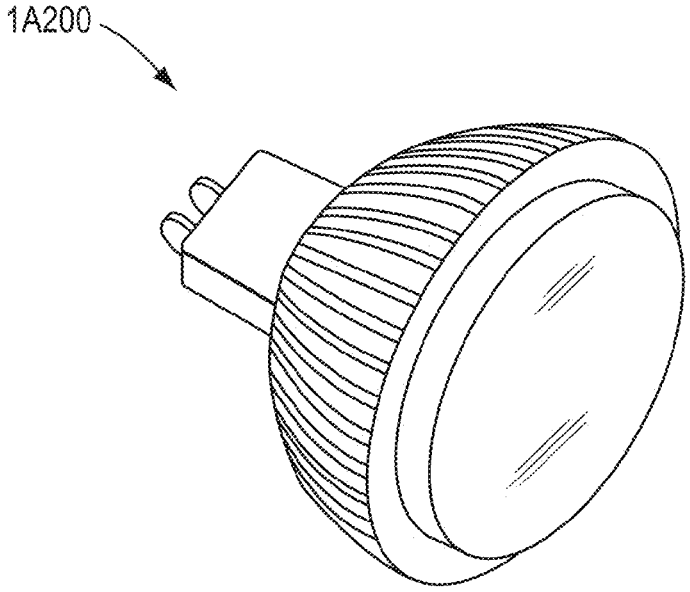
FIG. 1A2

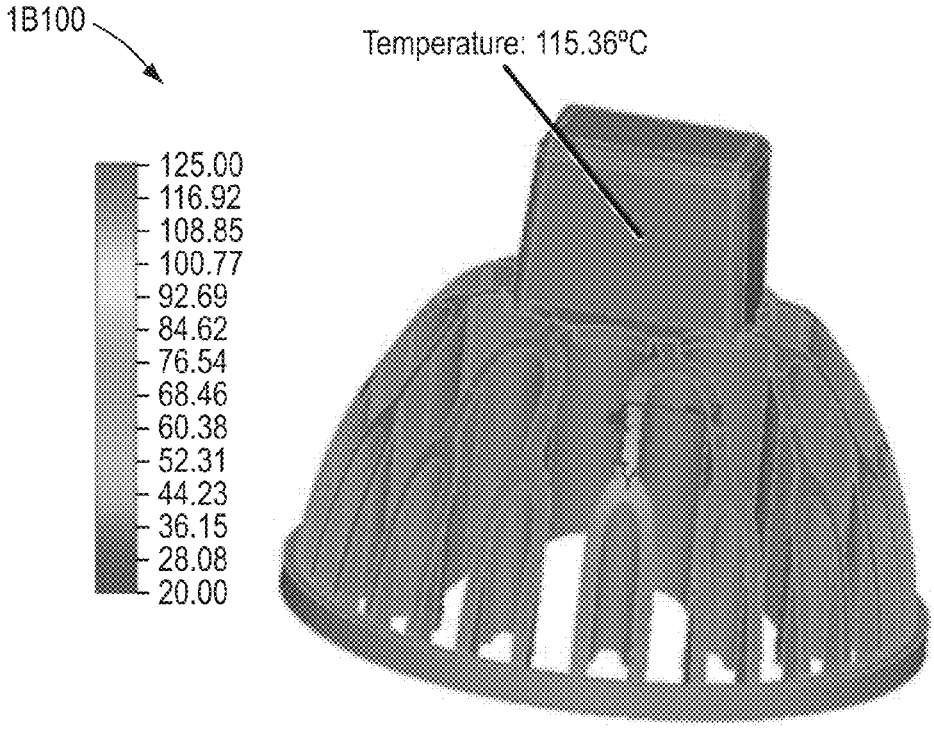
FIG. 1B1
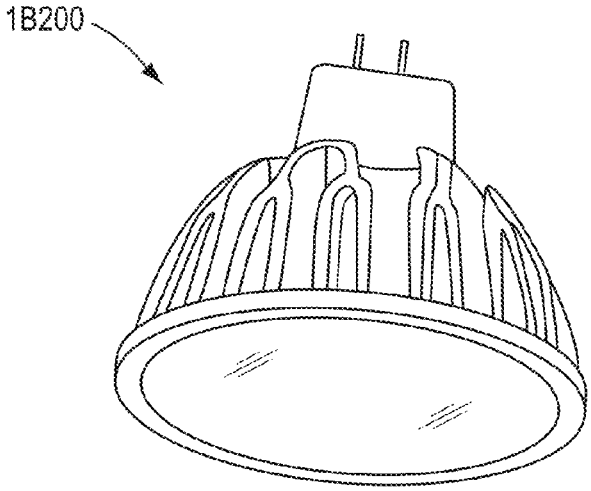
FIG. 1B2

HEAT DISSIPATION (12W LAMP)
LC - 8.4W
Driver base - 2.3W
Lens - 0.23W

- In 20°C free air
- Facing down
- Die cast aluminum

MULTI-PART HEAT EXCHANGER FOR LED LAMPS

This application claims the benefit under 35 U.S.C. §119 (e) of U.S. Provisional Application No. 61/851,513 filed on Mar. 8, 2013, which is incorporated by reference in its entirety.

FIELD

The disclosure relates to the field of LED illumination products and more particularly to multi-part heat exchangers for hot/cold temperature domain isolation in LED lamps.

BACKGROUND

LED lamps combine electronic components that operate at high current and high temperatures (e.g., high-current density light-emitting diodes) with other electronics that operate a low currents and low temperatures (e.g., driver electronics, capacitors, etc.). For example, an array of high-current light-emitting diodes can operate sustainably at temperatures over 120° C. In contrast, driver electronics operate sustainably at room temperature, and in some cases, cannot operate reliably at sustained temperatures of over 120° C.

One legacy approach is to position driver electronics away from the high-temperatures of the high-current density components. While this technique applies in some situations (e.g., where there is sufficient distance) it is not always the case that the space and air-flow/temperature-flow considerations permit sufficient heat dissipation away from the driver electronics. One such example arises with the form factor of an MR-16 LED lamp.

In certain legacy situations, the MR-16 driver components are required to meet automotive or military application specifications (e.g., in order to operate reliably at such high temperatures). However, components that meet automotive or military application specifications often are more costly, and/or do not have desired performance characteristics. For instance, application-appropriate capacitors simply do not have the performance characteristics needed to concurrently meet electrical design constraints and also to operate within a high temperature domain.

Therefore, there is a need for improved approaches for controlling heat flow in LED lamps.

BRIEF DESCRIPTION OF THE DRAWINGS

Those skilled in the art will understand that the drawings, described herein, are for illustration purposes only. The drawings are not intended to limit the scope of the present disclosure.

FIG. 1A1 and FIG. 1A2 are illustrations showing certain LED illumination products where the electronic driver and heat exchanger that is used to manage the temperature of light generating diode are both mechanically and thermally integrated together.

FIG. 1B1 shows a simulated surface temperature profile of a lamp where the electronic driver and heat exchanger that is used to manage the temperature of the light generating diode are both mechanically and thermally integrated together. The driver housing region at the base of an LED illumination product is of approximately the same temperature as the heat exchanger.

FIG. 1B2 shows a line illustration of the lamp shown in FIG. 1B1.

FIG. 2 is a plan view of an LED illumination product that uses a multi-part heat exchanger to provide hot/cold temperature domain isolation in LED lamps, according to some embodiments.

DETAILED DESCRIPTION

Figure 2:
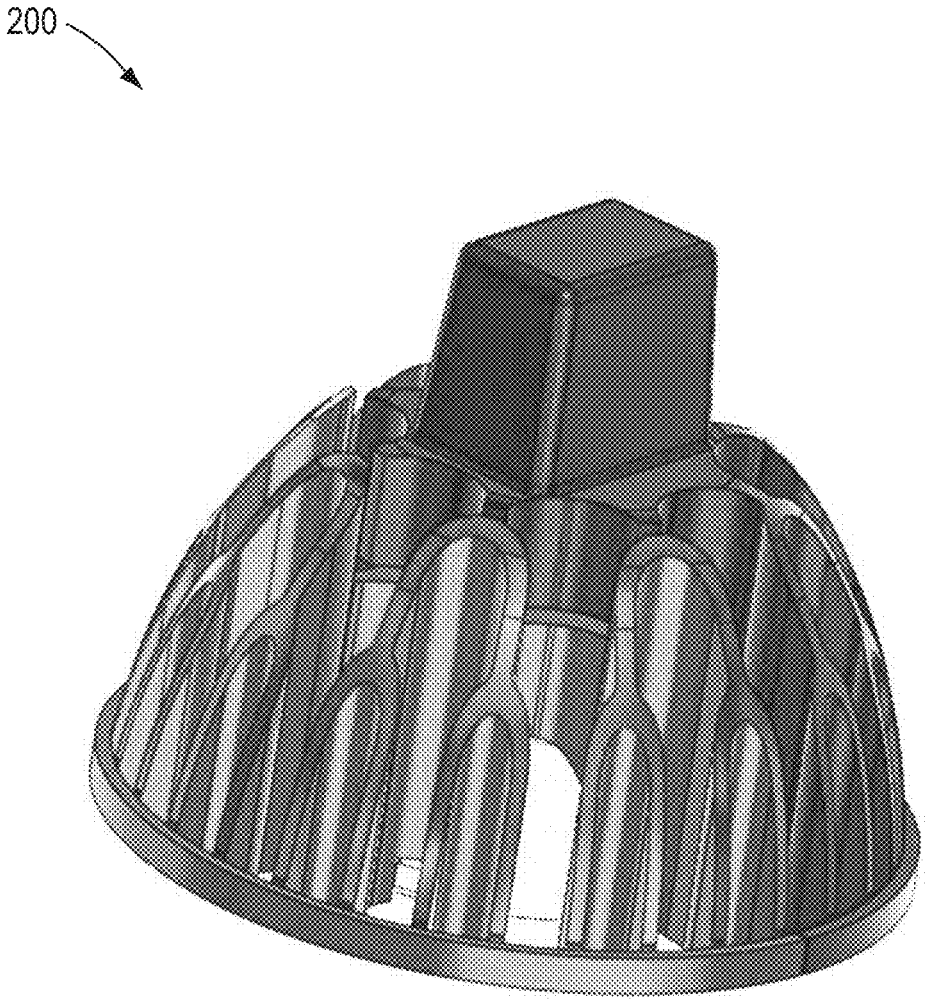

The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The term "or" is intended to mean an inclusive "or" rather than an exclusive "or". That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances. In addition, the articles "a" and "an" as used in this application and the appended claims should generally be construed to mean "one or more" unless specified otherwise or is clear from the context to be directed to a singular form.

The term "logic" means any combination of software or hardware that is used to implement all or part of the disclosure.

The term "non-transitory computer readable medium" refers to any medium that participates in providing instructions to a logic processor.

A "module" includes any mix of any portions of computer memory and any extent of circuitry including circuitry embodied as a processor.

Reference is now made in detail to certain embodiments. The disclosed embodiments are not intended to be limiting of the claims.

SUMMARY

In some illumination products the heat exchanger that is used to cool the light source and electronics that drive the light source are constructed such that they are not only mechanically united but also thermally connected to each other. Those products often exhibit a nearly-uniform body temperature especially in the natural convection environment. Therefore the electronic driver temperature is linked to the light source temperature due to its closeness in proximity and thermal coupling. Some light sources, specifically light emitting diodes, can operate reliably in very high temperatures, for instance 120° C. junction temperature, but the electrical driver components, which usually compromises tens to hundreds of various electrical components often cannot operate in such a high temperature for an extended time without using high temperature rated components, which are costly. The other way to solve the problem is to sacrifice high temperature capability of the light source to operate the lamp at a low power/low temperature mode that the driver can reliably operate in which case the whole lamp performance was compromised. In that implementation the light source delivers less lumens than is possible under high-power/high temperature conditions.

Embodiments are directed to an illumination product that uses a multi-part (e.g., two-part) heat exchanger design. The light source and the electrical driver each have their own respective heat exchangers to manage their respective temperatures separately. Those heat exchangers, when assembled together, can conform to standard bulb profiles or form factors (e.g., MR-16). To achieve a still greater temperature difference between the light source and electrical driver, the two-parts or multiple-parts comprising the heat exchangers should be thermally isolated, or at least in separate thermal domains. One technique to provide thermal isolation is to provide an air gap between the heat exchangers. Or, solid thermal insulation material can also be used to isolate the parts of heat exchangers. When heat exchangers are isolated, the light source and electrical driver can maintain different temperatures and operate under their own optimal temperatures in their own respective temperature domains. This allows the driver to run at a lower temperature than the light source, and allows a higher current operation of the light source.

The same approach can be used to manage not only the light source and the driver temperatures but also the temperature of other sensitive components in the illumination product, such as the lens. One part of a multi-part heat exchanger can be used to cool the optical lens.

DETAILED DESCRIPTION

FIG. 1A1 and FIG. 1A2 show illustrations 1A00 of LED illumination products that can accept a multi-part heat exchanger for hot/cold temperature domain isolation.

FIG. 1B1 shows a relatively lower temperature housing region 1B00 at the base of an LED illumination product that may benefit by the use of a multi-part heat exchanger for hot/cold temperature domain isolation in LED lamps. FIG. 1B2 shows a line drawing of the lamp illustrated in FIG. 1B1.

FIG. 2 is a plan view 200 of an LED illumination product that uses a multi-part heat exchanger for hot/cold temperature domain isolation in LED lamps. The different colors represent separate parts of the multi-part heat exchanger.

Figure 3:
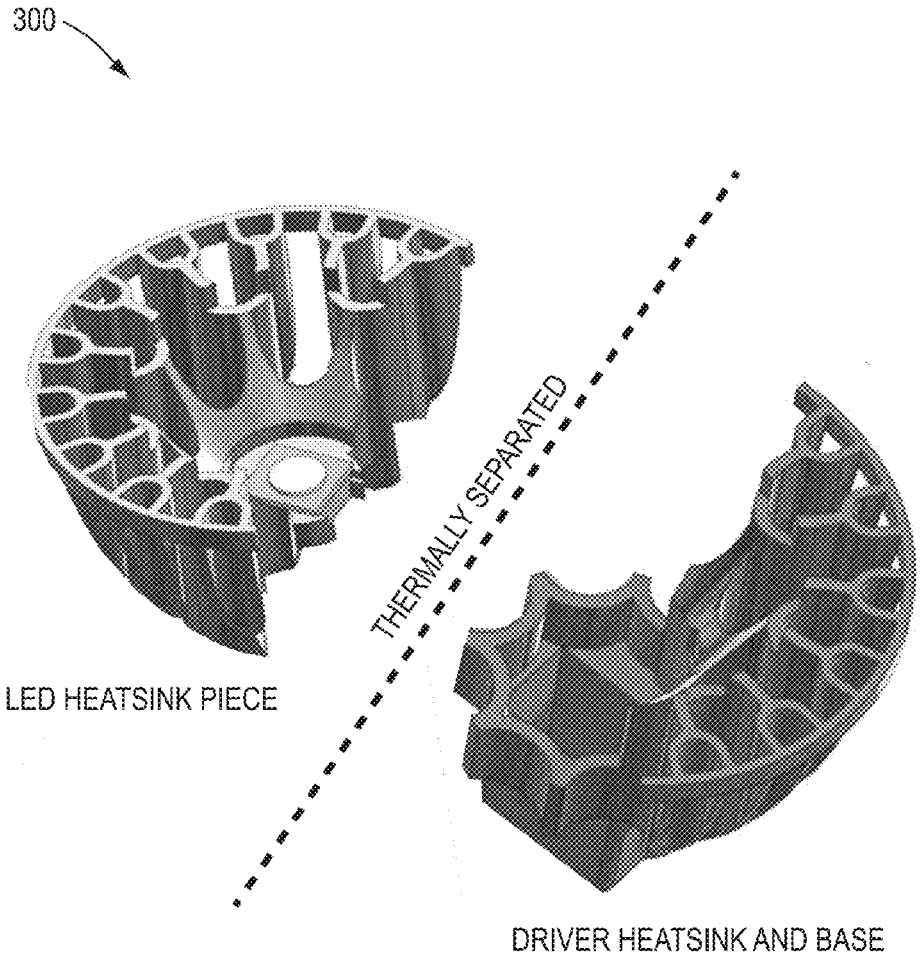
FIG. 3 is an exploded view showing selected components of an LED illumination product that uses multi-part heat exchanger hot/cold temperature domain isolation in LED lamps, according to some embodiments.

FIG. 3 is an exploded view 300 showing selected components of an LED illumination product that uses a multi-part heat exchanger for hot/cold temperature domain isolation in LED lamps. As shown in FIG. 3 the lamp is separated into two parts: an LED heatsink piece and a driver heatsink and base piece. The two parts are thermally separated when assembled in a lamp product.

Figure 4:
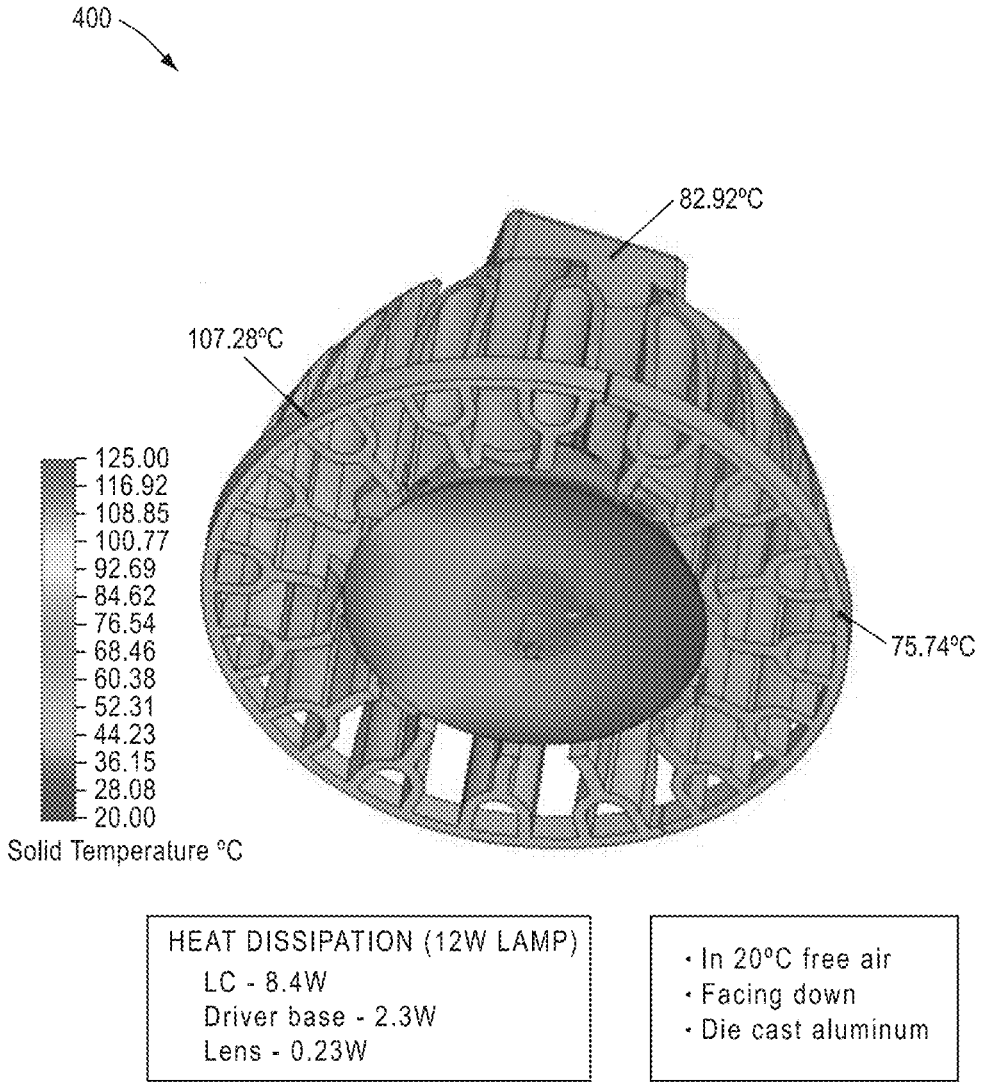
FIG. 4 is a plan view showing selected temperatures from an LED illumination product that employs multi-part heat exchanger hot/cold temperature domain isolation in LED lamps, according to some embodiments. Compared to the uniform body temperature in illumination products, in the embodiment of FIG. 4, the driver base heat exchanger temperature is significantly lower than the light source heat exchanger temperature.

FIG. 4 is a plan view 400 showing selected temperature measurements from an LED illumination product that uses a multi-part heat exchanger for hot/cold temperature domain isolation in LED lamps. The two parts of the multi-part heat exchanger can be identified by the different colors. The part comprising the driver heatsink and base is characterized by a lower temperature, for example, a temperature of 75.74° C. than the part comprising the LED heatsink characterized by a temperature of 107.28° C. The base of the lamp is characterized by a temperature of 82.92° C.

Figure 5:
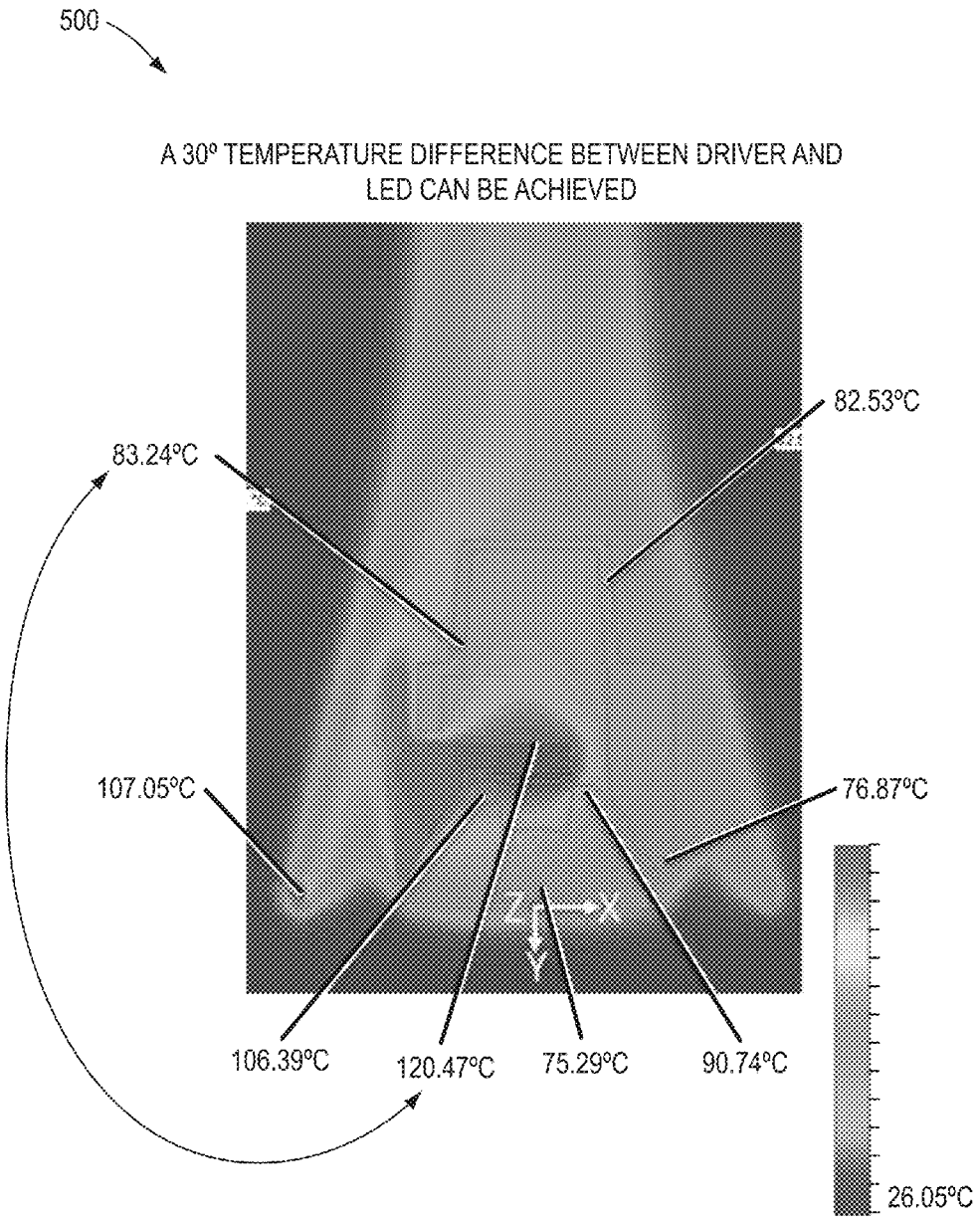
FIG. 5 is a side view showing selected temperature values at various points of an LED illumination product that uses multi-part heat exchanger hot/cold temperature domain isolation for LED lamps, according to some embodiments. The driver base temperature is significantly lower than the light source temperature.

FIG. 5 is a side view 500 showing selected temperature values at various points of an LED illumination product that uses a multi-part heat exchanger for hot/cold temperature domain isolation in LED lamps.

Figure 6:
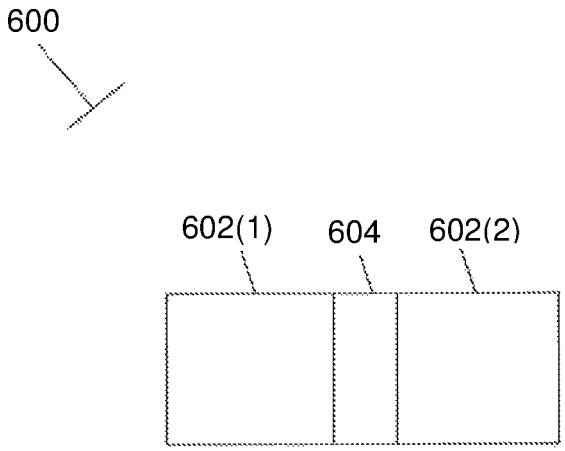
FIG. 6 shows a two-part heat exchanger with a thermally insulating layer according to one embodiment.

FIG. 6 shows a two-part heat exchanger with a thermally insulating layer according to one embodiment. As shown in FIG. 6A, first portion 602(1) of heat exchanger 600 is thermally insulated from second portion 602(2) of heat exchanger 600 via insulating layer 604. Insulating layer 604 may be, for example, an air gap or thermal insulating material.

In certain embodiments, the temperature difference between the driver and the LED is at least 10° C., at least 20° C., at least 30° C., and in certain embodiments at least 40° C.

There are many ways to construct the multi-part heat exchanger. Embodiments shown in the figures (e.g., FIG. 2 and FIG. 3) give examples of splitting the heat exchanger vertically into two pieces. It can be split into more than two pieces, such as, into three or four pieces. The heat exchangers can be arranged in horizontal direction or in other configurations, for example, one piece is outside and the other piece is inside. The size of each piece can be varied to achieve an optimal operating temperature for a light source, driver, and other components that can be cooled and are directly or indirectly attached to each piece of the heat exchanger. Each heat generating source, such as the light source, can be directly or indirectly attached to more than one piece of a multi-part heat exchanger. The material of each piece of heat exchanger can be different. For example, one piece may be metal and another piece may be plastic.

Finally, it should be noted that there are alternative ways of implementing the embodiments disclosed herein. Accordingly, the present embodiments are to be considered as illustrative and not restrictive, and the claims are not to be limited to the details given herein, but may be modified within the scope and equivalents thereof.

What is claimed is:

1. An LED lamp apparatus, comprising:

a light-emitting diode;

a multi-part heat exchanger comprising a first portion and a second portion wherein the first portion of the multi-part heat exchanger is in direct or indirect physical contact with the light-emitting diode;

at least one electrical component configured to drive the light-emitting diode wherein the second portion of the multi-part heat exchanger is in direct or indirect physical contact with the at least one electrical component; and wherein the first portion of the multi-part heat exchanger is thermally isolated from the second portion of the multi-part heat exchanger such that the light emitting diode and first portion are configured to operate at a first temperature and the at least one electrical component and said second portion are configured to operate at a second temperature, the second temperature being lower than the first temperature.

2. The apparatus of claim 1, wherein the first portion of the multi-part heat exchanger is at least partially thermally-isolated from the second portion of the multi-part heat exchanger by a physical distance.

3. The apparatus of claim 2, wherein thermal isolation is achieved by an air gap between the said first portion and the second portion of the multi-part heat exchanger.

4. The apparatus of claim 2, wherein thermal isolation is achieved by a solid thermal insulation material between the first portion and the second portion of the multi-part heat exchanger.

5. The apparatus of claim 1, wherein the at least one electrical component to drive the light-emitting diode includes a capacitor.

6. The apparatus of claim 1, wherein the at least one electrical component configured to drive the light-emitting diode comprises a resistor.

7. The apparatus of claim 1, wherein the LED lamp is in the form factor of at least one of, an MR-16 lamp, an A series lamp, a PS series lamp, a B series lamp, a C series lamp, a CA series lamp, an RP series lamp, an S series lamp, an F series lamp, an R series lamp, an MR series lamp, a BR series lamp, a G series lamp, a T series lamp, a BT series lamp, an E series lamp, an ED series lamp, an AR series lamp, and a PAR series lamp.

8. An illumination device, comprising:

a light source having at least one light-emitting diode;

a multi-part heat exchanger comprising a first portion and a second portion wherein the first portion of the multi-part heat exchanger in direct or indirect physical contact with the light-emitting diode;

at least one electrical component configured to drive the light-emitting diode wherein the second portion of the multi-part heat exchanger is in direct or indirect physical contact with the at least one electrical component; and wherein the first portion of the multi-part heat exchanger is thermally isolated from the second portion of the multi-part heat exchanger such that the light emitting diode and first portion are configured to operate at a first temperature and the at least one electrical component and said second portion are configured to operate at a second temperature, the second temperature being lower than the first temperature.

9. The illumination device of claim 8, wherein the illumination device is at least one of, an MR-16 lamp, an A series lamp, a PS series lamp, a B series lamp, a C series lamp, a CA series lamp, an RP series lamp, an S series lamp, an F series lamp, an R series lamp, an MR series lamp, a BR series lamp, a G series lamp, a T series lamp, a BT series lamp, an E series lamp, an ED series lamp, an AR series lamp, and a PAR series lamp.

10. The device of claim 8, wherein the first portion of the multi-part heat exchanger is at least partially thermally-isolated from the second portion of the multi-part heat exchanger by a physical distance.

11. The device of claim 10, wherein thermal isolation is achieved by an air gap between the said first portion and the second portion of the multi-part heat exchanger.

12. The device of claim 10, wherein thermal isolation is achieved by a solid thermal insulation material between the first portion and the second portion of the multi-part heat exchanger.

13. The device of claim 8, wherein the at least one electrical component to drive the light-emitting diode includes a capacitor.

14. The device of claim 8, wherein the at least one electrical component configured to drive the light-emitting diode comprises a resistor.

15. The device of claim 1, wherein the first and second portions conform to standard lamp form factor.

16. The device of claim 1, wherein said first portion comprises a first heat sink and said second portion comprises a second heat sink, wherein that the light emitting diode and first sink are configured to operate at a first temperature and the at least one electrical component and said second sink are configured to operate at a second temperature, the second temperature being lower than the first temperature.

* * * * *